US005300909A

United States Patent [19]

Wilson

[11] Patent Number: 5,300,909

[45] Date of Patent: Apr. 5, 1994

[54] SELECTOR SWITCH SHIELD

[75] Inventor: James M. Wilson, 421 Perkins Rd., Leesville, La. 71446

[73] Assignee: James Matthew Wilson, Leesville, La.

[21] Appl. No.: 895,989

[22] Filed: Jun. 8, 1992

[51] Int. Cl.[5] ..... H01F 7/00

[52] U.S. Cl. ..... 335/278; 220/DIG. 21

[58] Field of Search ..... 74/608, 566; 220/376, 220/DIG. 25, 724, DIG. 21, 664, 676, 663, 3.2, 3.3, 3.9; 229/93; 206/276, 206, , 275; 335/278; 29/DIG. 3, DIG. 13

[56] References Cited

U.S. PATENT DOCUMENTS

| | | | |
|---|---|---|---|
| 2,284,466 | 9/1939 | Zelt | 220/3.3 |
| 2,550,362 | 10/1947 | Logie | 220/DIG. 25 |
| 3,263,905 | 8/1966 | Kucka | 229/93 |
| 4,186,363 | 1/1980 | Schmidt | 335/278 |
| 4,600,033 | 7/1986 | Baron | 220/724 |
| 4,648,526 | 3/1987 | Wood | 220/724 |
| 5,004,117 | 4/1991 | Kitsuda | 220/724 |

FOREIGN PATENT DOCUMENTS

| | | | |
|---|---|---|---|
| 1260130 | 9/1989 | Canada | 220/3.9 |
| 685129 | 12/1952 | United Kingdom | 220/3.9 |

*Primary Examiner*—Leo P. Picard
*Assistant Examiner*—Stephen T. Ryan

[57] ABSTRACT

A shielding device having an embossement affixed at one end, and also having a mounting fixture affixed to the enclosure at or near center and having another mounting fixture at the remaining end of the enclosure and it being relieved of radiused and linear portions at each end.

2 Claims, 2 Drawing Sheets

SELECTOR SWITCH SHIELD

BACKGROUND OF THE INVENTION

The present invention relates to a shield and more particularly to a shield to protect the feeder assembly selector solenoid switch from damage during removal, transportation, and installation of feeder assembly housing, making feeder assembly solenoid inoperable, as used on the Bradley Fighting Vehicle's 25 mm cannon.

By working closely with the armies TIACOM officers and local LAR representatives for the U.S. Army, we have been able to discuss reoccurring problems and solutions to eliminate these problems.

SUMMARY OF THE INVENTION

In accordance with this invention, the problem stated and other difficulties have been eliminated by providing a complete shielding device. This device provides protection to the feeder solenoid, yet does not hinder operation or function to the solenoid or the operator. This design allows quick removal and replacement of the solenoid shield or solenoid for normal maintainance, inspection and solenoid malfunction, this being done by removing the designated anchoring screws.

DESCRIPTION OF THE PREFERRED EMBODIMENT

Figure 1:
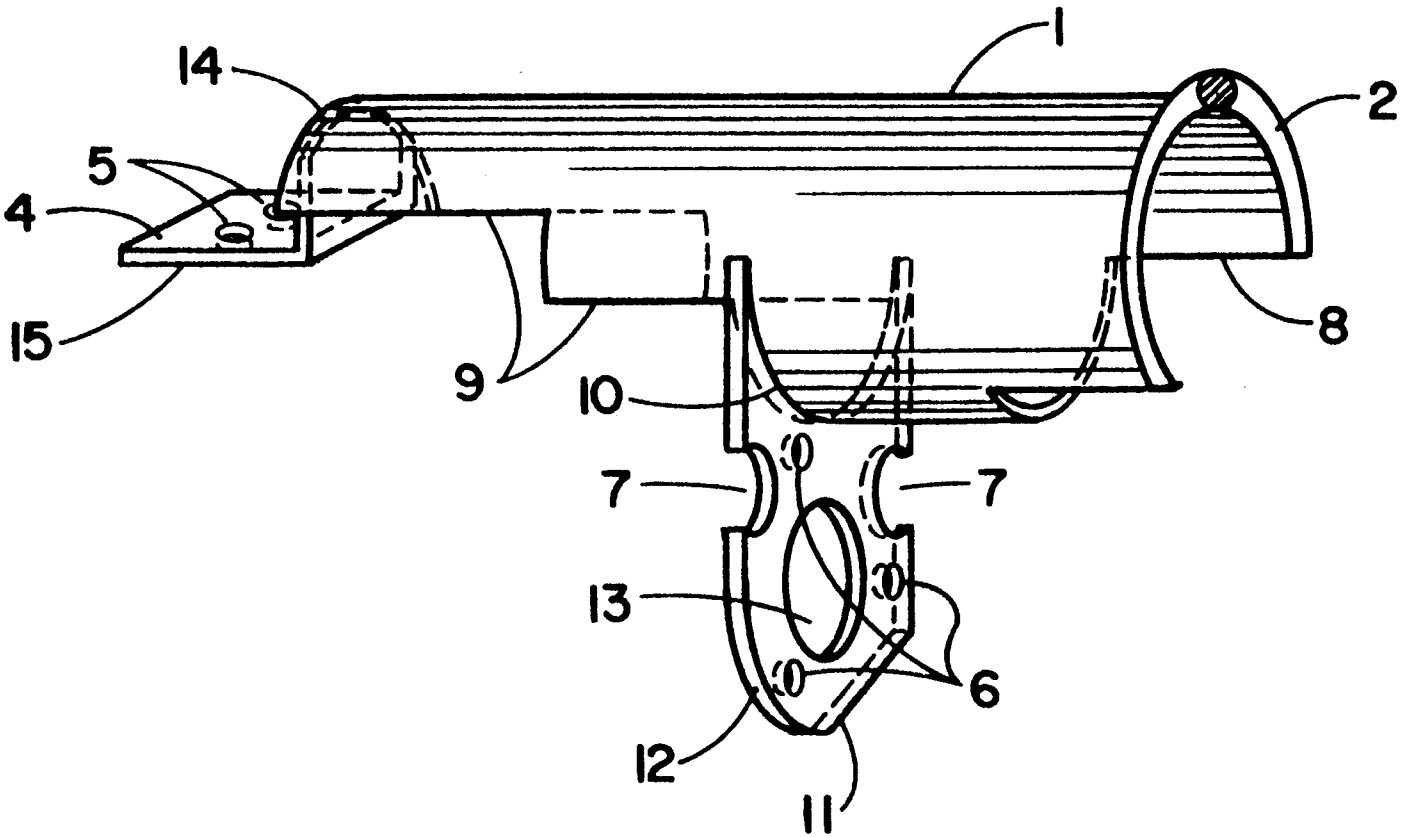
FIG. 1 is a perspective view of the solenoid shield.

Referring first to perspective view FIG. 1, the enclosure 1 there illustrated includes an embossed end 2 affixed to the remaining segment of enclosure 1. The enclosure also includes a mounting fixture 3 affixed to enclosure 1 perpendicular to center line of enclosure 1 and parallel to embossed edge 2. Mounting fixture 3 also includes openings 6 for mounting. Mounting fixture 3 also includes relief segments 7.

Enclosure 1 also includes a mounting fixture 4 affixed to the remaining segment of enclosure 1 and perpendicular to center line of enclosure 1 and parallel to mounting fixture 3. Mounting fixture 4 also includes openings 5 for mounting.

Figure 3:
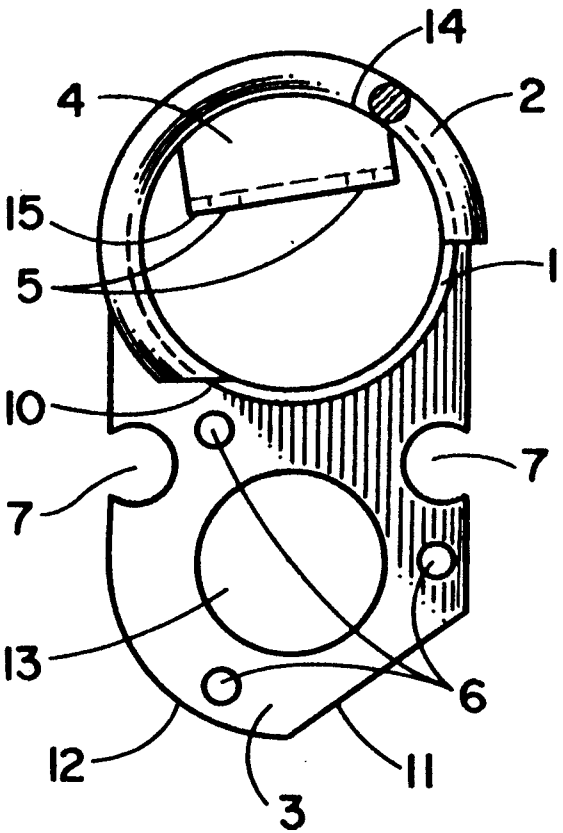
FIG. 3 is a right end view of the feeder solenoid shield.
Figure 2:
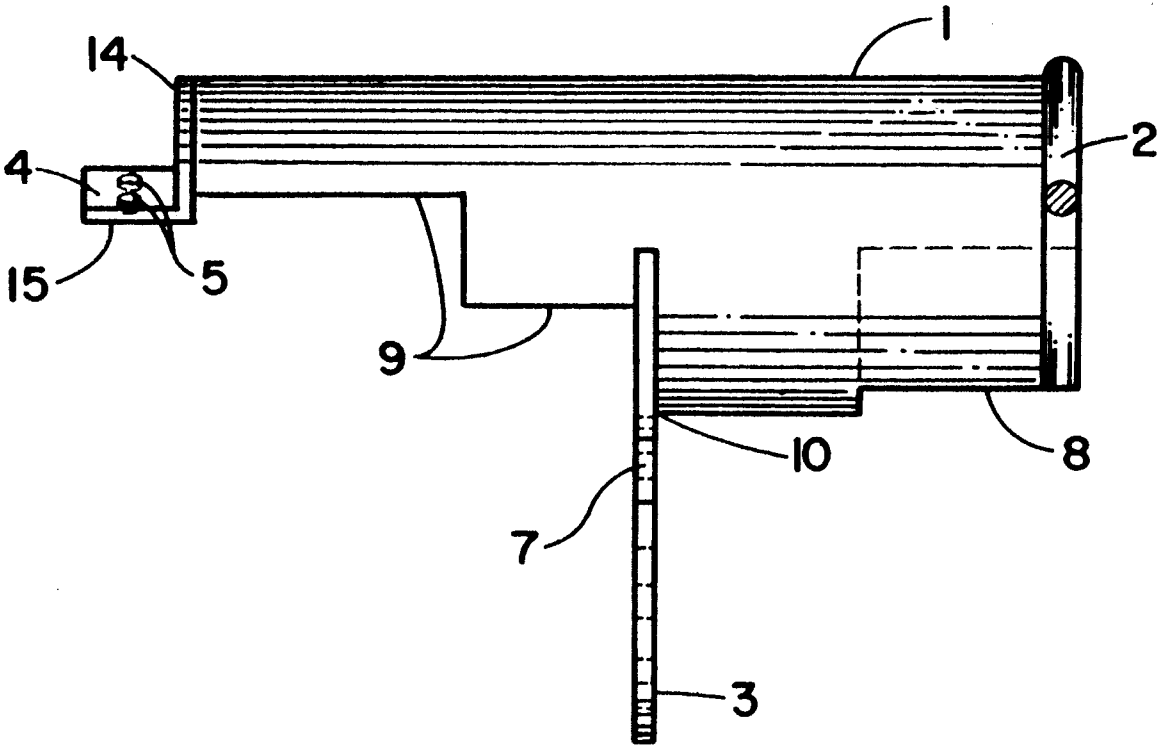
FIG. 2 is a side view of the feeder solenoid shield.

FIG. 3 illustrates mounting fixture 4's relation to enclosure 1 line of center as viewed from embossed end.

By having this shield formed in the manner shown, the shield in its application provides complete protection yet easy access and operation of the feeder selector switch.

It is understood that various changes can be made by one skilled in the art, in the arrangement, form, construction and material of the apparatus disclosed herein without departing from the scope or spirit of the present invention.

I claim:

1. A shield for preventing damage to a manually operated selector solenoid comprising:

a hollow open-ended cylindrical tube with one end, an opposite end and a longitudinal axis;

at least one curved surface portion removed from an end of said tube;

a first mounting fixture affixed to said tube, said first mounting fixture comprising a flat plate lying in a plane perpendicular to said longitudinal axis, including holes through said first mounting fixture for mounting said tube and giving clearance to the mechanics of the solenoid feeder assembly; and a second mounting fixture affixed to said one end of said tube, including holes through said second mounting fixture for mounting said tube.

2. The shield of claim 1 including an embossed lip at said opposite end of said tube.

* * * * *